US005408771A

United States Patent [19]

Manrubia

[11] Patent Number: 5,408,771

[45] Date of Patent: Apr. 25, 1995

[54] LIGHTED BOX FRAME WITH 3-DIMENSIONAL MATTING

[76] Inventor: Bob Manrubia, 1251 Lerma La., Gilroy, Calif. 95020

[21] Appl. No.: 195,703

[22] Filed: Feb. 14, 1994

Related U.S. Application Data

[63] Continuation-in-part of Ser. No. 127,306, Sep. 27, 1993, abandoned.

[51] Int. Cl.[6] ..... G09F 13/00

[52] U.S. Cl. ..... 40/152.2; 40/155; 40/158.1; 362/227

[58] Field of Search ..... 40/154, 155, 158.1, 40/152.2, 152; 362/97, 227

[56] References Cited

U.S. PATENT DOCUMENTS

| | | | |
|---|---|---|---|
| 1,480,375 | 1/1924 | Cristadoro | 40/152.2 |
| 2,181,827 | 11/1939 | Ziemmerman | 40/154 |
| 2,677,909 | 5/1954 | Heydenryk | 40/152.2 |
| 3,205,600 | 9/1965 | Snyder | 40/152.2 |
| 3,214,855 | 11/1965 | Winkler et al. | 40/154 |
| 4,771,560 | 9/1988 | Richards | 40/607 |
| 4,870,766 | 10/1989 | Topping | 40/154 |
| 4,901,461 | 2/1990 | Edwards et al. | 40/564 X |
| 5,245,775 | 9/1993 | Goserud | 40/642 |

FOREIGN PATENT DOCUMENTS

| | | | |
|---|---|---|---|
| 590022 | 1/1960 | Canada | 40/154 |
| 1201051 | 12/1959 | France | 40/593 |

*Primary Examiner*—Brian K. Green
*Attorney, Agent, or Firm*—Keith Kline

[57] ABSTRACT

A 3-dimensional matting insert that is fitted inside a transparent box cover, including a source of lighting for the artwork to be displayed. The matting insert is created from a cardboard blank that is folded in such a way as to provide a rectangular box with an open area in its center which serves as a display area for a picture or drawing or other object to be displayed. The device also includes holes to facilitate hanging the finished work. The matting insert can be used with a picture in either the recessed area for display, or reversed so that a flat area is in contact with the picture. If the second option is chosen, the device functions as a standard box frame.

5 Claims, 3 Drawing Sheets

LIGHTED BOX FRAME WITH 3-DIMENSIONAL MATTING

This application is a continuation-in-part of applicant's U.S. application Ser. No. 08/127,306 filed Sep. 27, 1993, now abandoned.

FIELD OF THE INVENTION

The present invention relates generally to picture frames, and more particularly is a 3-dimensional box frame with interior lighting.

BACKGROUND OF THE INVENTION

Picture frames are of many varieties, from very simple to fairly complex. In addition to mounting pictures in a frame, a user may add many extra effects with the use of one or more mattings to highlight the picture.

One type of frame that is sometimes used, although not typically used with mattings, is the box frame. In one of its embodiments, the box frame comprises a transparent box with a means for securing a picture against its surface.

The use of box frames and the use of mattings is well known in the prior art. However to date, no one has provided a simple way to utilize a box frame and mattings together, or to provide a means of recessing the picture in a box frame to achieve "depth" in the presentation.

A further enhancement of the effect of the frame can be achieved if an interior lighting system is provided in the frame.

OBJECTS, SUMMARY, AND ADVANTAGES OF THE INVENTION

Accordingly, it is an object of the present invention to provide a box frame including a means of creating a 3-dimensional matting.

It is a further object to provide a convenient means of hanging the work.

It is a still further object to provide a box frame with interior lighting means to illuminate the framed work.

The present invention is a 3-dimensional matting insert that is fitted inside a transparent box cover. The matting insert is created from a chipboard blank that is folded in such a way as to provide a rectangular box with a recessed area in its center which serves as a display area for a picture or drawing or other object to be displayed.

A lighting source is provided in the interior of the box frame to illuminate the work, thus further enhancing the display effect.

The device also includes holes to facilitate hanging the finished work.

The matting insert can be used with a picture in either the recessed area for display, or reversed so that a flat area is in contact with the picture. If the second option is chosen, the device functions as a standard box frame.

It is envisioned that the device of the present invention will be used in conjunction with standard 2-dimensional mattings to achieve desired visual effects.

An advantage of the present invention is that it provides a simple, inexpensive method to provide "depth" to a display of visual arts.

A further advantage of the present invention is that the matting area may be reversed to serve as a standard box frame.

A still further advantage of the present invention is that it has an integral lighting means, thus enabling enhancement of the displayed art that cannot be achieved with exterior lighting.

Another advantage of the present invention is that it provides convenient means of hanging the picture.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 3:
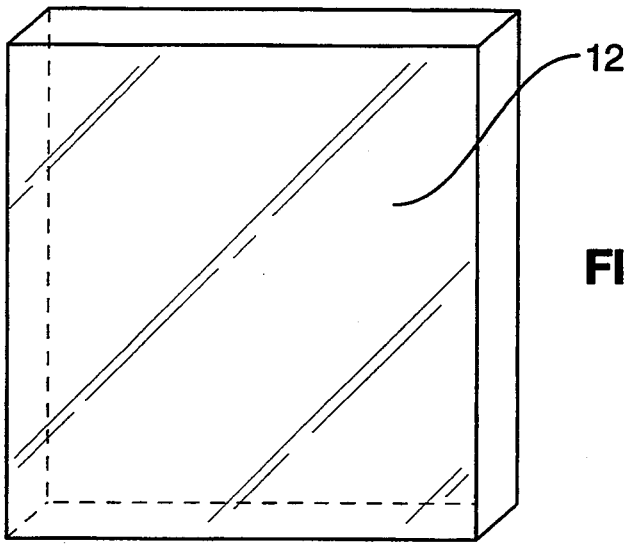
FIG. 3 is a front perspective view of the transparent box cover.

The present invention is a type of box frame. The frame includes a 3-dimensional matting insert 10 which in its folded state appears as in FIG. 1. In use, the matting insert 10 is covered by a transparent box 12, shown in FIG. 3.

Figure 4:
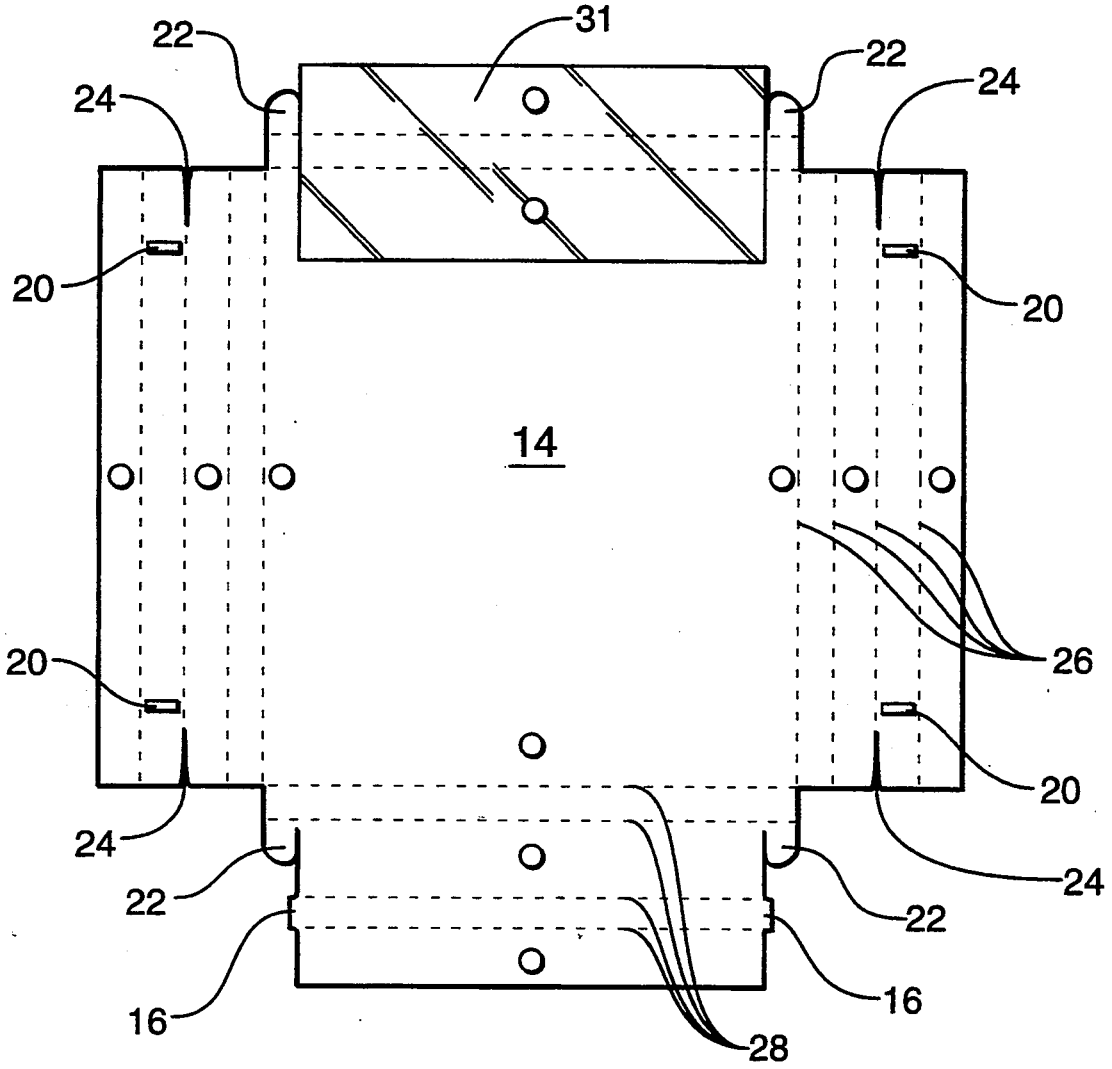
FIG. 4 is a top plan view of the chipboard blank used to construct the matting cover.

The matting insert 10 is constructed from a chipboard blank 14, shown in FIG. 4. While this embodiment is described utilizing chipboard, it is recognized that any rigid material that can be folded may be utilized in the present invention.

The blank utilized in the present invention is nearly identical to that disclosed in Applicant's prior disclosure, U.S. Ser. No. 08/127,306, and is in fact obtained from suppliers in identical form. The modification required for the present invention is the removal of two sections of a panel of the blank so that after construction of the insert, there is an opening in the wall of the insert to allow light to pass from the interior of the insert to the display area.

The matting insert 10 includes tapered tabs 16 which fit into slotted apertures 20. The blank 14 further includes rounded tab areas 22 which fit into slots 24. Vertical scored lines 26 and horizontal scored lines 28 aid in assembling the blank into the frame. Hanging holes 30 are also provided in the blank 14 for a user's convenience.

An area 31 of the blank 14 is covered with reflective material so that light is better reflected into the display area of the finished frame.

Figure 5:
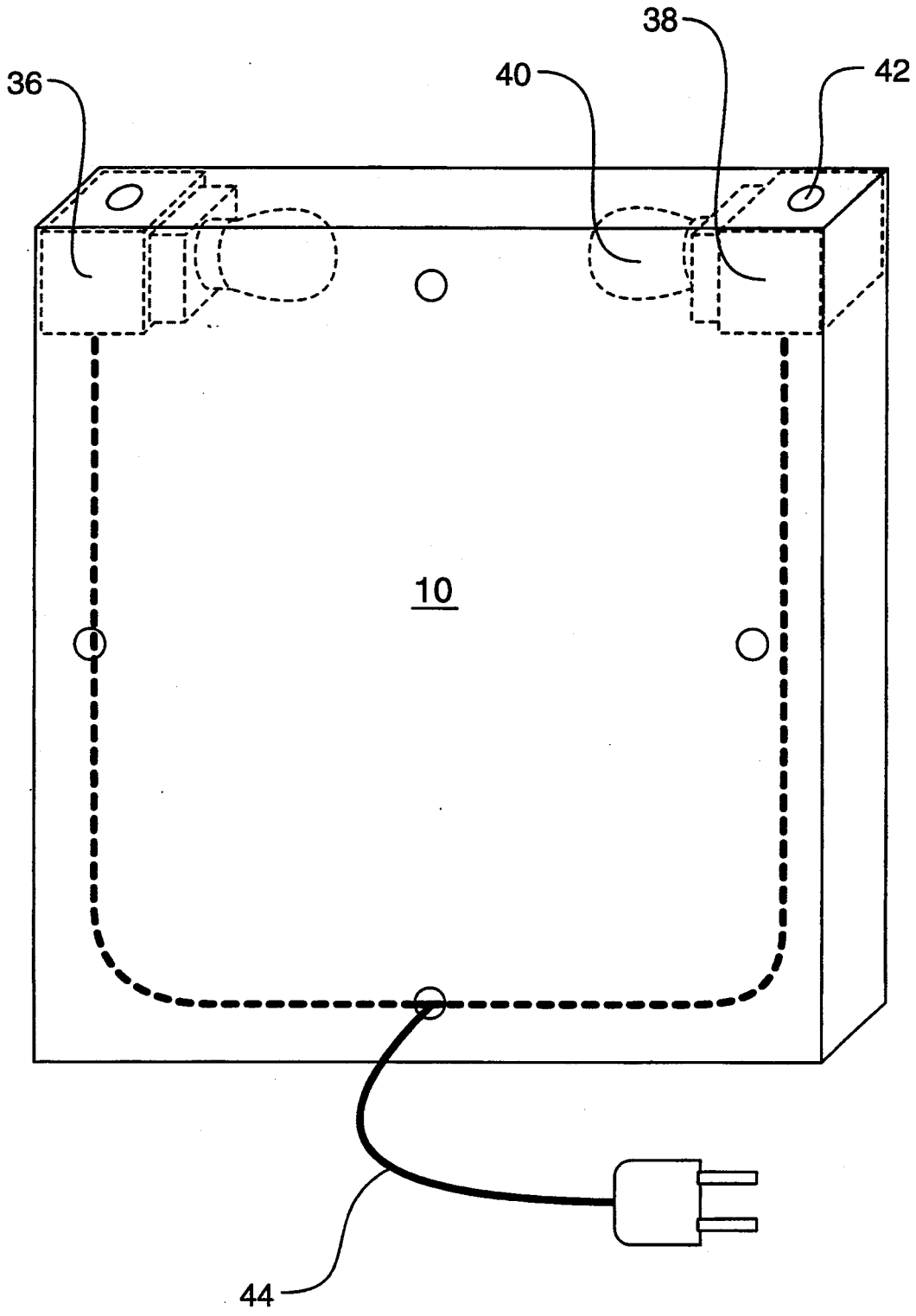
FIG. 5 is a rear perspective view of the box frame of the present invention with integral lighting means.

As shown in FIG. 5, lighting elements 36 are included in the interior of the insert 10. While two elements 36 are illustrated in this disclosure, any number of elements can be utilized. However, the most common numbers of elements 36 will be two, as shown, and four, one element in each corner of the frame.

The lighting elements 36 comprise a base 38 and a bulb 40. A on/off sensor 42 is provided on the base 38. An electrical line 44 supplies power to the lighting elements 36.

The on/off sensors 42 are used to monitor the ambient light to determine when it is necessary to activate the lighting elements 36. When the ambient light drops below a predetermined level, power is supplied to the lighting elements 36. If desired by the user, the on/off sensors 42 can be replaced by in-line switches for manual operation.

Construction of the matting insert 10 is accomplished as follows: The lighting elements 36 are placed on the blank 14 in the desired position. The lighting elements 36 may be secured to the blank 14 by securing means such as tape or some other adhesive. The size of the base 38 of the elements 36 can be selected so that the elements 36 fit securely in the perimeter of the insert 10, thus requiring little or no securing means.

The chipboard is then folded along vertical scored lines 26 which are stamped into side portions of the blank 14. The folding causes a rectangular boxed area to be formed along each side of the device. The electrical line 44 is contained within these boxed areas. The exterior end of the line 44 is passed through one of the hanging holes 30 to provide convenient accessibility for an electrical outlet.

It should be noted that due to the way that the chipboard blank 14 is folded, the back of the boxed areas is comprised of a double layer of chipboard. This provides extra strength around the perimeter of the frame and particularly around the hanging holes 30.

The blank 14 is next folded along the two innermost horizontal scored lines 28. This causes the rounded tabs 22 to fit inside the upper surface of the rectangular boxed areas formed by the vertical folds described above. The tabs 22 are secured in the slots 24.

The blank 14 is then folded along the remaining two horizontal lines 28, with the tapered tabs 16 being insert into the slotted apertures 20. Note that the hanging holes 30 will now be aligned so that only one hole appears when the matting insert 10 is viewed directly from the front or from the rear.

Because the uppermost segments of the blank 14 were removed upon receipt from the vendor, the corresponding boxed area is open on one side. This allows light to pass freely into the display area.

Figure 1:
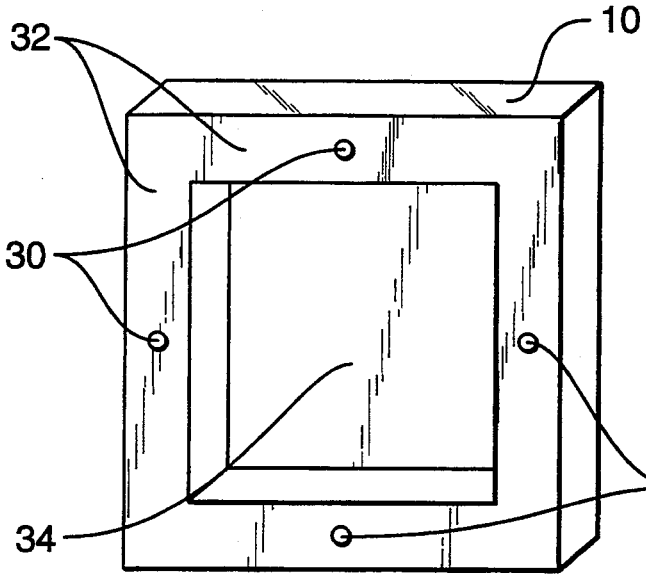
FIG. 1 is a front perspective view of the 3-dimensional matting insert.
Figure 2:
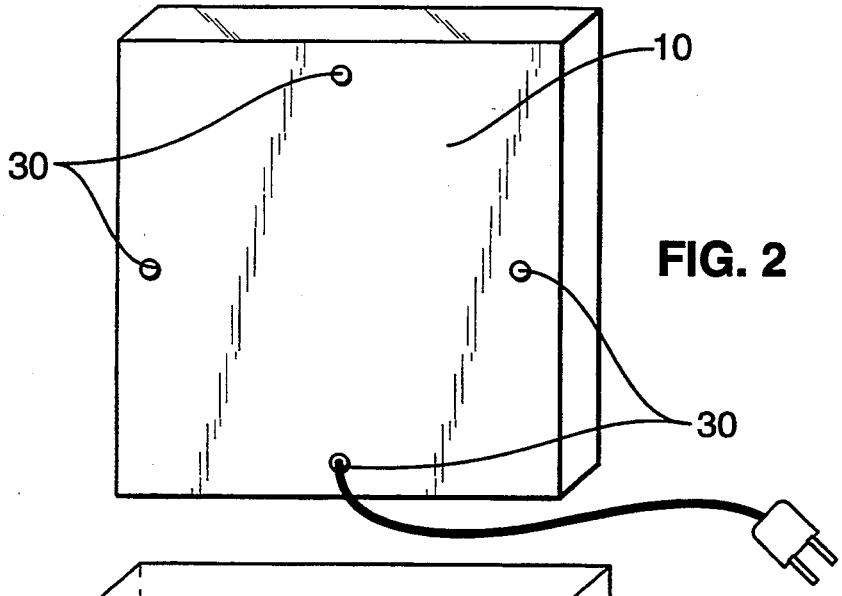
FIG. 2 is a rear perspective view of the 3-dimensional matting insert.

As shown in FIG. 1, the matting insert 10 is now in the form of a box with a wide raised perimeter 32, and includes a recessed center area 34. Light will pass from the lighting elements into the center display area 34 through the opening in the upper side of the perimeter.

The art to be presented is then inserted into the recessed area 34 in the matting insert 10. Additional conventional two-dimensional flat mattings are then added as desired. Note that at least one two-dimensional matting will be required to cover the hanging holes 30 when the art is displayed in the recessed area 34.

The matting insert 10 is then placed into the transparent box 12 for display. The size of the insert 10 is chosen so that it is held in place in the box 12 by a friction fit. The holes 30 in the insert 10 may be utilized for hanging the art.

The present invention may also be utilized by reversing the matting insert 10 and simply using the flat rear surface to secure the art against the box 12.

While the preferred embodiment of the present invention utilizes a transparent cover box 12, it is envisioned that the matting insert 10 may also be used in conjunction with wood or metal frames as well.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A box frame comprising:

a 3-dimensional matting insert including a wide raised perimeter with a recessed center area, said recessed area being of sufficient depth to contain an artwork having a non-negligible thickness desired to be displayed by a user, the matting insert further including preformed holes to facilitate hanging; and a transparent cover box which fits over the matting insert, said cover box comprising a central display cover area which covers said recessed area, said cover box further including side panels integral thereto which extend perpendicularly from said central cover area, said side panels extending to a distance sufficient to cover said raised perimeter of said matting insert; and wherein at least one light source is provided in an interior of the raised perimeter, the light source being placed in the interior of the raised perimeter during normal construction of the matting insert, said light source being positioned such that the source is not visible to a viewer.

2. The box frame of claim 1 wherein:

the operation of the light source is controlled by sensors which determine the level of ambient light, and cause the light source to be activated when the amount of ambient light drops below a pre-determined level.

3. A box frame comprising:

a 3-dimensional matting insert including a wide raised perimeter with a recessed center area, said recessed area being of sufficient depth to contain an artwork having a non-negligible thickness desired to be displayed by a user, the matting insert further including preformed holes to facilitate hanging; and a transparent cover box which fits over the matting insert, said cover box comprising a central display cover area which covers said recessed area, said cover box further including side panels integral thereto which extend perpendicularly from said central cover area, said side panels extending to a distance sufficient to cover said raised perimeter of said matting insert; and wherein the matting insert is formed by folding a flat cardboard blank to form the raised perimeter;

the blank includes tapered tabs which are inserted into slotted apertures and rounded tabs which are inserted into slots to fix the raised perimeter securely in place;

the blank further includes pre-punched holes which align when the blank is folded to form convenient hanging holes; and at least one light source is provided in an interior of the raised perimeter so that the source is not visible to a viewer.

4. The box frame of claim 3 wherein:

the operation of the light source is controlled by sensors which determine the level of ambient light, and cause the light source to be activated when the amount of ambient light drops below a pre-determined level.

5. A box frame comprising:

a 3-dimensional matting insert including a wide raised perimeter with a recessed center area, said recessed area being of sufficient depth to contain an artwork having a non-negligible thickness desired to be displayed by a user, the matting insert further including preformed holes to facilitate hanging; and a transparent cover box which fits over the matting insert, said cover box comprising a central display cover area which covers said recessed area, said cover box further including side panels integral thereto which extend perpendicularly from said central cover area, said side panels extending to a distance sufficient to cover said raised perimeter of said matting insert; wherein the matting insert is formed by folding a flat cardboard blank to form the raised perimeter, the blank including tapered tabs which are inserted into slotted apertures and rounded tabs which are inserted into slots to fix the raised perimeter securely in place, the blank further including said preformed holes which align when the blank is folded to form convenient hanging holes;

the matting insert including at least one light source placed in an interior of the raised perimeter during normal construction of the matting insert so that the source is not visible to a viewer, the light source illuminating the displayed artwork, and wherein the operation of the light source is controlled by sensors which determine the level of ambient light, and cause the light source to be activated when the amount of ambient light drops below a pre-determined level.

* * * * *